US005243730A

United States Patent [19]

Ichitsubo et al.

[11] Patent Number: 5,243,730

[45] Date of Patent: Sep. 14, 1993

[54] APPARATUS FOR CLEANING ELECTRONIC GAME CONSOLES AND CARTRIDGES

[75] Inventors: Norio Ichitsubo, Osaka, Japan; Hiroshi Kamada; Lance Barr, both of Redmond, Wash.

[73] Assignee: Nintendo of America Inc., Redmond, Wash.

[21] Appl. No.: 681,748

[22] Filed: Apr. 8, 1991

Related U.S. Application Data

[63] Continuation of Ser. No. 450,079, Dec. 13, 1989, Pat. No. 5,025,526.

[51] Int. Cl.[5] ..... B08B 11/00

[52] U.S. Cl. ..... 15/210.1; 15/118; 51/205 WG

[58] Field of Search ..... 15/118, 208, 209 R, 15/210 R, 210 A, 214, 218, 219, 220 R, 228, 231-233, 247; 51/205 WG, 392; 604/1; 360/137

[56] References Cited

U.S. PATENT DOCUMENTS

| | | | |
|---|---|---|---|
| 1,636,083 | 4/1926 | Stewart . | |
| 3,789,452 | 2/1974 | Nemoto | 15/210 R |
| 4,100,643 | 7/1978 | Horian et al. | 15/97.1 |
| 4,428,092 | 1/1984 | Lipari | 15/246 |
| 4,454,551 | 6/1984 | Claussen et al. | 15/210 R |
| 4,518,823 | 5/1985 | Kessler | 179/2 |
| 4,542,950 | 9/1985 | Gillett et al. | 339/75 |
| 4,560,223 | 12/1985 | Cooney et al. | 339/95 |
| 4,634,210 | 1/1987 | Crawford | 339/176 |
| 4,647,140 | 3/1987 | Crawford | 339/176 |
| 4,705,338 | 11/1987 | Sitzler | 439/260 |
| 4,716,485 | 12/1987 | Yeung | 360/128 |
| 4,733,678 | 3/1988 | Bolois | 134/115 |
| 4,744,764 | 5/1988 | Rubenstein | 439/62 |
| 4,795,354 | 1/1989 | Owen | 439/137 |
| 4,951,425 | 8/1990 | Naghi | 15/210 R |
| 4,993,100 | 2/1991 | Halboth et al. | 15/118 |

*Primary Examiner*—Edward L. Roberts
*Attorney, Agent, or Firm*—Nixon & Vanderhye

[57] ABSTRACT

Cleaning apparatus for an electronic game console and associated game cartridges, wherein the game console is of the type having a first edge connector adapted to engage a mating second edge connector provided in the game cartridge. The cleaning apparatus includes a cleaning cartridge having a housing portion at one end and a handle portion at the other end, the housing portion having first and second separable portions, and having a recessed forward end. A first cleaning element is mounted within the recessed forward end, the cleaning element being sized and shaped to correspond substantially to the first edge connector, so that the cleaning pad engages the second edge connector upon insertion into the game console port. A second cleaning element is carried within the housing portion of the cartridge, the second cleaning element including an elongated member having a washing pad on one end thereof and a drying pad on the other end thereof, for cleaning the edge connector of the game cartridge.

8 Claims, 3 Drawing Sheets

FIG. 4
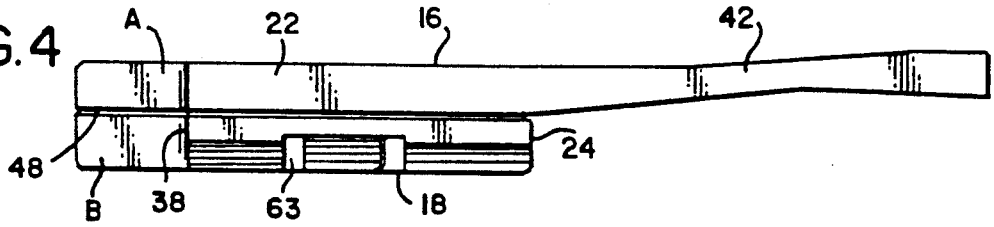
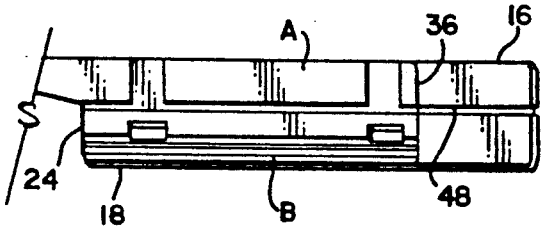
FIG. 5
FIG. 6
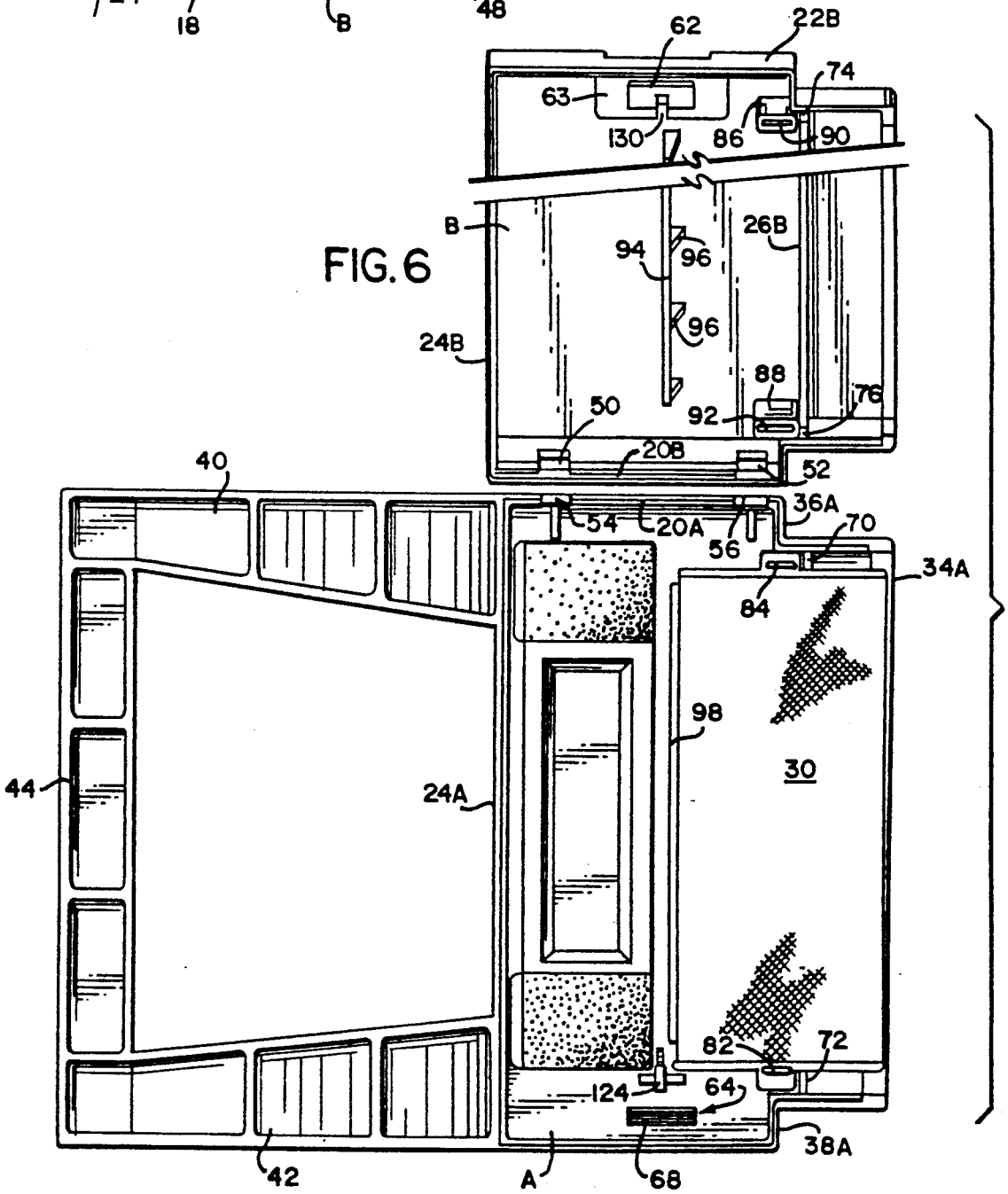

APPARATUS FOR CLEANING ELECTRONIC GAME CONSOLES AND CARTRIDGES

This is a continuation of application Ser. No. 07/450,079, filed Dec. 13, 1989, now U.S. Pat. No. 5,025,526.

BACKGROUND AND SUMMARY OF THE INVENTION

This invention relates to electronic game apparatus, and specifically to apparatus for cleaning the edge connectors of electronic game consoles of the type which have ports for receiving game cartridges.

It is important for mating edge connectors incorporated within both a game console and a game cartridge to be maintained in as clean a condition as possible to insure high quality performance of the unit. Periodic cleaning of such edge connectors is necessary to remove dust particles and other debris which may be present on either the game console connectors or the cartridge connectors. It is, of course, desirable to make the cleaning process a simple one that can be carried out easily by the consumer in the home, thereby avoiding more costly and time consuming efforts involved in carrying or shipping the console and/or cartridges to a service outlet or the like.

More specifically, the cleaning apparatus in accordance with an exemplary embodiment of the invention comprises a cartridge constructed of relatively rigid, plastic material, and which includes a housing portion and a handle portion. The housing portion includes a top wall, a bottom wall, two side walls, a back wall and a front wall. The front wall is set back within a recessed forward end of the cartridge portion and extends substantially along the entire front edge of the housing portion.

A cleaning pad is mounted within the housing portion so that a forward end extends through the front wall, but does not extend beyond the forward edges of the recess as defined by the forward edges of the top, bottom and two side walls. This forward recessed end of the cartridge is also narrowed in width so as to simulate the forward end configuration of game cartridges, thereby allowing the cleaning cartridge to fit within the game console port in the same manner as a game cartridge.

The handle portion of the cartridge extends rearwardly from the back or rear wall of the housing portion and includes a pair of spaced arms and a rearwardmost connecting member which thereby facilitates gripping of the cartridge for ease of insertion and removal of the cleaning cartridge from the game console.

The housing portion is also formed as separable upper and lower sections for accessing the interior of the housing portion. As will be described in greater detail below, the interior surfaces of the top and bottom walls of the housing portion are provided with various surfaces for supporting the cleaning pad in a clamped configuration when the upper and lower housing sections are closed. In addition, a plurality of tabs and recesses or apertures are provided within the housing portion to enable precise alignment and releasably locking connection between the respective separable housing sections. These will also be described further herein.

The cleaning pad itself comprises a planar card like substrate having front and rear edges as well as a pair of side edges, the latter including apertured tabs for mounting the cleaning pad within the housing portion of the cartridge. The card or substrate is wrapped with a cleaning fabric, preferably a lint-free fabric such as nylon impression fabric, i.e., typewriter ribbon material. The overall symmetrical shape of the cleaning pad, including the apertured tabs, is such that the pad is easily reversible to present one or the other of the opposite front and rear edges of the cleaning pad for cleaning engagement with the edge connectors of the game console.

Space is also provided within the housing portion of the cartridge rearwardly of the mounting area of the cleaning pad, for storing a second cleaning tool for cleaning the edge connectors of associated game cartridges. This second tool comprises an elongated plastic member, one end of which is wrapped with a suitable cleaning or washing material (preferably lint free), and the other end of which is wrapped with a suitable drying material (also preferably lint free).

Thus, the present invention provides a quick and easy solution to the problem of periodic cleaning of electronic game equipment in the form of a cleaning cartridge which, in one exemplary embodiment, comprises a housing portion having a recess formed along one side thereof, the recess defined by extensions of the top, bottom and side walls of the housing; a cleaner pad mounted within the recess and spaced from the top, bottom and side walls; and a handle portion extending away from an opposite side of the housing.

In another aspect, the present invention is directed to cleaning apparatus for electronic game consoles which have at least one port for receiving a game cartridge, the port having a first edge connector adapted to engage a mating second edge connector provided in the game cartridge, the apparatus comprising a cartridge including a housing portion having a recess formed at one end thereof and a handle portion provided at the other end thereof; a cleaning pad mounted within the recess, the pad being sized and shaped to correspond substantially to the first edge connector so that the cleaning pad engages the second edge connector upon insertion of the cartridge into the port.

In still another aspect, the invention is directed to a cleaning kit for an electronic game console and associated game cartridges, the game console having a first edge connector adapted to engage a mating second edge connector provided in the game cartridge, the kit comprising a cleaning cartridge having a housing portion at one end and a handle portion at the other end, the housing portion having first and second separable sections, the housing portion having a recessed forward end; a first cleaning element mounted within the recessed forward end, the cleaning element being sized and shaped to correspond substantially to the first edge connector, so that the cleaning pad engages the second edge connector upon insertion into the port; and a second cleaning element for cleaning the second edge connector in the game cartridge and carried within the cartridge, the second cleaning element including an elongated member having a washing pad on one end thereof and a drying pad on the other end thereof. The second element is intended to be used to clean the game cartridge edge connector, and to then be returned to the cartridge housing portion for future use.

Other objects and advantages of the disclosed invention will become apparent from the detailed description which follows.

BRIEF DESCRIPTION OF THE DRAWINGS

FIG. 4 is a side elevation of the cartridge shown in FIG. 1;

FIG. 5 is a partial side elevation of the opposite side of the cartridge illustrated in FIG. 1;

FIG. 6 is a bottom view of the cartridge illustrated in FIG. 1 with the lower section of the housing shown separated from the upper section of the housing, and illustrating the cleaning elements mounted within the interior of the housing;

DETAILED DESCRIPTION OF THE DRAWINGS

Figure 1:
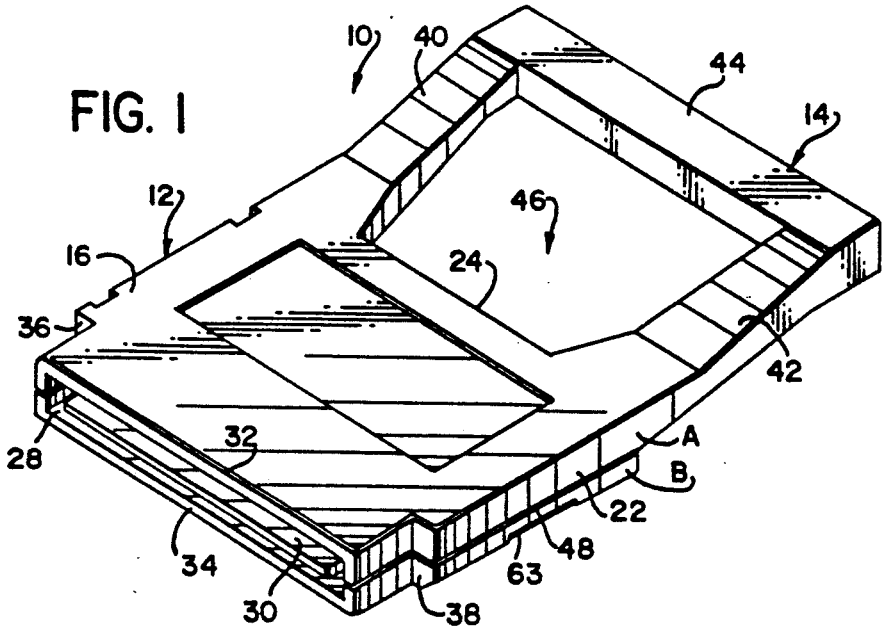
FIG. 1 is a perspective view of a cleaning cartridge in accordance with one exemplary embodiment of the invention.

With reference to FIGS. 1–4, the cleaning apparatus in accordance with the invention comprises a cartridge 10 which includes a housing portion 12 and a handle portion 14. The housing portion 12 is shaped substantially in the manner of a game cartridge, and is provided with a top wall 16, bottom wall 18, side walls 20, 22 and a back wall 24. A front wall 26 is set back within a recess 28 which extends substantially along the entire front edge of the housing. In other words, the top and bottom walls 16, 18, respectively, and side walls 20 and 22 extend beyond the front wall 26 to define the recess 28.

A cleaning pad 30 extends through the front wall 26 and terminates within the recess 28, in substantial alignment with the forward edges 32, 34 of the top wall 16 and bottom wall 18, respectively, as will be explained in greater detail below.

It will be seen from the drawings that the front end of the cartridge, i.e., the end to be inserted within the game console port, is narrowed in width relative to the remainder of the cartridge by reason of shoulders 36, 38, respectively. The narrowed front end is sized to fit within the game console port, with shoulders 36, 38, serving as a stop to limit insertion to a predetermined distance.

The handle portion 14 extends rearwardly from the back wall 24 of the housing portion and includes two spaced arms 40, 42 and a connecting cross member 44, defining an opening 46, thereby permitting gripping the cartridge about the cross member 44, thereby facilitating insertion and removal of the cartridge from the game console.

In one exemplary embodiment, the housing portion 12 is also formed as separable upper and lower sections A, B, joined along a seam 48 extending about substantially the mid-point of walls 20, 22, 24 and 26. The manner and means by which the upper and lower sections A and B are joined will be described in greater detail below. It will be seen from the various Figures, and especially FIGS. 1, 3 and 4 that the handle portion 14 is formed integrally with the upper housing section A, and that lower section B includes no par of the handle portion 14. It will be appreciated, of course, that the handle portion 14 need not be integrally formed with the housing portion, but may be formed separately and joined thereto by any suitable means.

Figure 7:
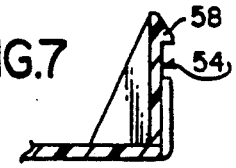
FIG. 7 is a partial detail illustrating a mounting tab utilized to secure the upper and lower housing sections in accordance with the invention.
Figure 12:
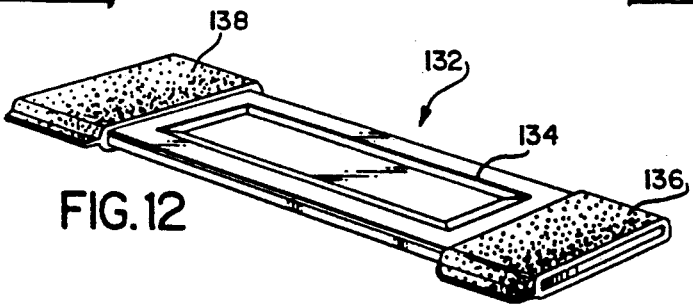
FIG. 12 is a perspective view of a second cleaning tool in accordance with an exemplary embodiment of the invention.

With reference now particularly to FIG. 6, it will be appreciated that the cartridge is shown there inverted relative to FIG. 1, and the lower housing section B is shown separated from the upper housing section A. Reference numerals in FIG. 6, including those referring to wall sections split by the separated sections, have an A or B appended thereto as appropriate. A pair of apertures 50, 52 are formed in side wall 20B of the housing section B, which are designed to receive a pair of upstanding tabs 54, 56 which extend above the upper half of the side wall 20A of the housing section A. Tabs 54, 56 are formed with lateral projections 58, 60 (see FIG. 7) at their uppermost, or free, ends so that, upon engagement with apertures 50, 52, the lower housing section B may be rotated to a closed position, with projections 58, 60 acting in the nature of a pivot or hinge.

Figure 8:
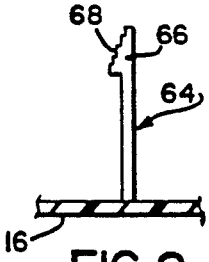
FIG. 8 is a partial detail of a locking tab used to secure the upper and lower housing sections in accordance with the invention.
Figure 10:
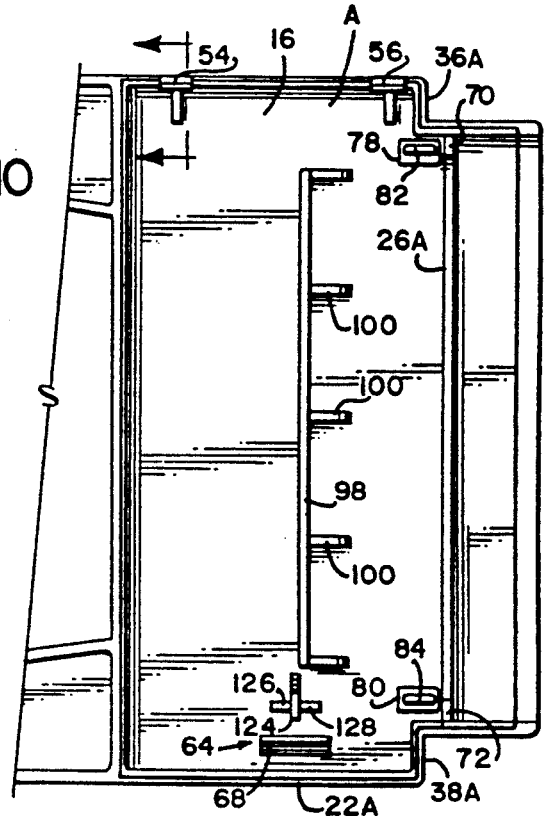
FIG. 10 is a partial bottom view of the cartridge as illustrated in FIG. 6, but with the cleaning elements removed.

The opposite side of lower section B is provided with a single aperture 62 in a recessed are 63 of the side wall 22B which is designed to receive a single upstanding tab 64 which, as best seen in FIGS. 8 and 10, projects upwardly from the inside surface of top wall 16, adjacent the side wall 22A. Tab 64 is formed similar to but larger than tabs 54, 56, and thus is provided with an outwardly extending lateral projection 66 which has a serrated surface portion 68. It will be appreciated that tab 64 is somewhat flexible so that, as the projection 66 engages aperture 62 upon closing, surface portion 68 is cammed inwardly, and then snaps outwardly over the exterior edge of the aperture 62 to resiliently lock the upper and lower housing sections. Further in this regard, it will be understood that lateral projections 58, 60 of tabs 54, 56, respectively, serve to lock the opposite side of the lower housing section B to the upper housing section A To open the cartridge, one need only press the serrated surface 68 to flex the tab 64 inwardly, so that the lower housing section B can be rotated away from the upper housing section A, with aperture 62 clearing the lateral projection 66. The housing sections A and B can then be separated completely, as the apertures 50, 52 are slipped over the tabs 54 and 56.

Figure 2:
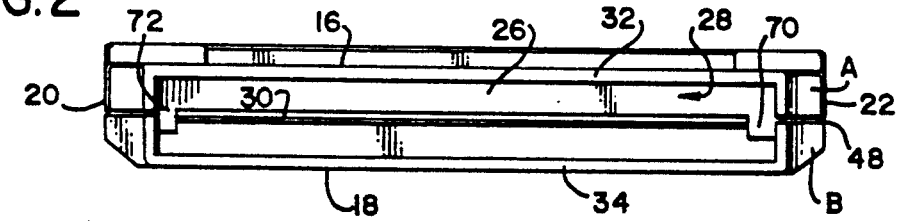
FIG. 2 is a front view of the cartridge illustrated in FIG. 1.
Figure 3:
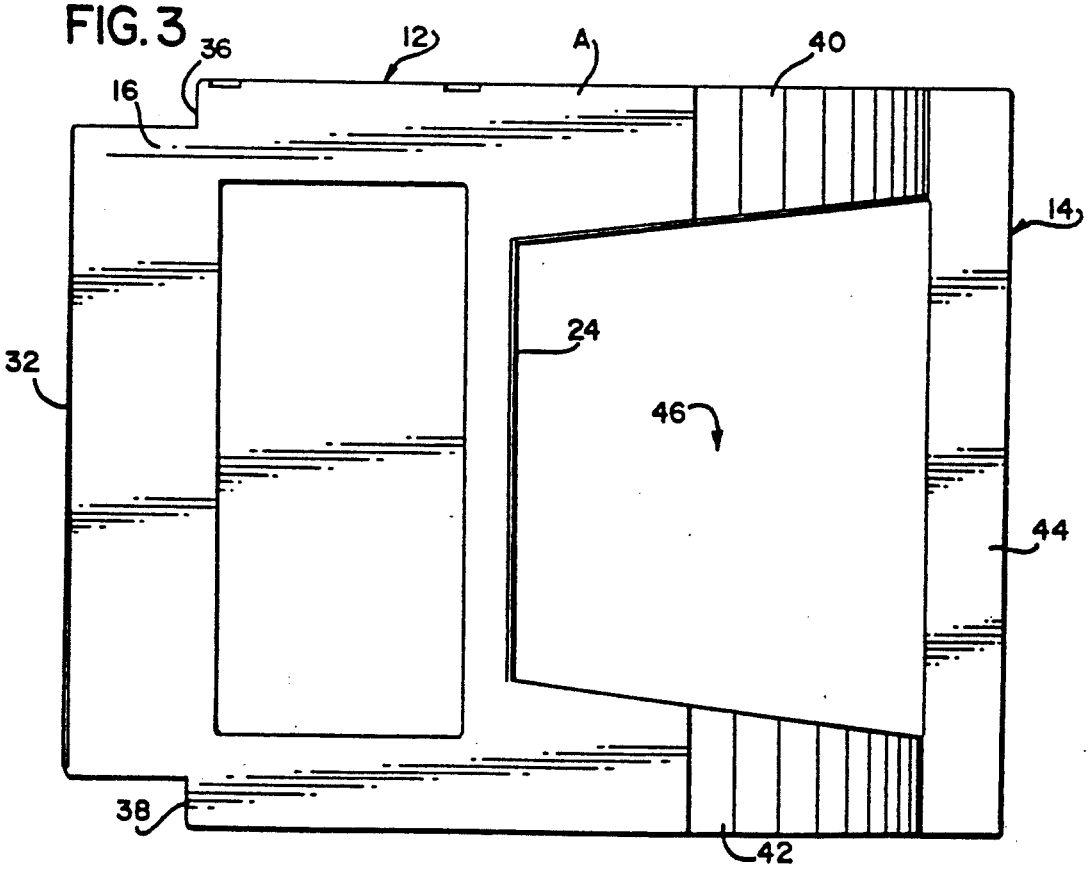
FIG. 3 is a top view of the cartridge illustrated in FIG. 1.
Figure 9:
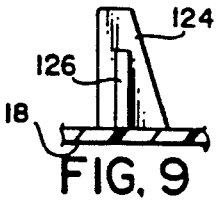
FIGS. 9 and 9A are partial details illustrating two view of an alignment and support element facilitating engagement of the upper and lower housing sections in accordance with the invention.
Figure 9A:
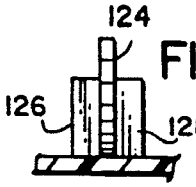

With reference now to FIG. 10, the interior surface of top wall 16 is formed with the upper half of front wall 26, i.e., wall 26A, extending across the rearward end of the recess 2B, just ahead of the lateral shoulders 36A, 38A. Wall 26A is formed with two raised portions 70, 72 to define therebetween a central portion corresponding substantially to the width of the cleaning pad 30. At the same time, and with reference to FIG. 6, the interior surface of bottom wall 18 is formed with the lower half of the front wall 26, i.e., wall 26B, extending across the rearward end of recess 28 so that when the upper and lower sections A and B are closed, walls 26A and 26B are in vertical alignment. Wall 26B has a pair of recesses 74, 76 at opposite ends, for receiving raised portions 70, 72 of wall 26A. The vertical extent of the respective middle sections of the upper and lower portions of the front wall 26 are such that when the upper and lower halves are secured, a slot is formed for receiving the cleaning pad as described hereinbelow, as best seen in FIG. 2.

Rearwardly of raised portions 70, 72 on the interior surface of top wall 16, housing section A, there are formed integral embossments 78, 80 with male connectors 82, 84, respectively, formed on the free ends thereof. Complementary embossments 86, 88 are formed on the lower housing section B with recesses or slots 90, 92. When the upper and lower housing sections A and B are closed, male connectors 82, 84 fit within female connectors 92, 90, respectively, insuring proper alignment and a snug fit between the housing sections A and B With further reference to FIG. 6, there is also formed on the interior surface of lower wall a pad support 94, extending parallel to but spaced rearwardly of the front wall 26. Forwardly extending ribs 96 are provided along the length of the wall 94, at a slightly lesser height than the wall 94.

At the same time, the interior surface of the upper wall 16 is provided with a pad abutment wall 98, which lies slightly rearward of wall 94, and is supported by a plurality of gussets 100 which also serve to support the cleaning pad 30 as described further below.

Figure 11:
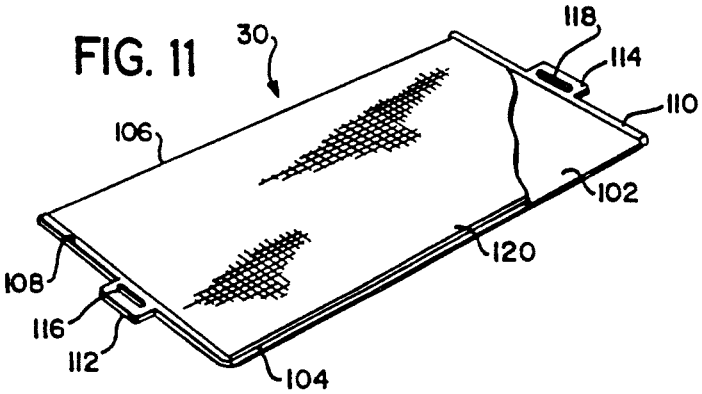
FIG. 11 is a perspective view of the cleaning pad in accordance with an exemplary embodiment of the invention.

Referring now to FIG. 11, the cleaning pad 30 comprises a planar, card-like, substrate 102, having front and rear edges 104, 106 and side edges 108, 110. Tabs 112, 114 are formed at approximately the mid-point of side edges 108, 110, respectively, with apertures 116, 118 formed therein. The card or substrate 102, which is preferably a relatively stiff plastic, is wrapped with a cleaning fabric 120, preferably a lint-free fabric such as nylon impression fabric, i.e., typewriter ribbon material.

With reference to FIG. 6, it may be seen that the cleaning pad 30 is mounted in the cartridge so that male connectors 82, 84 project through the apertures 116, 118, and the rearward edge 106 of the substrate abuts the wall 98 while being supported by the wall 94. Forward edge 104 lies ahead of the front wall 26, but within the recess 28, as already described.

When the upper and lower housing sections A and B are closed, connectors 82, 84 are received within slots 90, 92, and the pad 30 is clamped between the upper and lower portions 26A and 26B of the front wall 26, and between the pad support wall 94 and gussets 100. Abutment wall 98 provides for even further stabilization of the pad. It will thus be appreciated that upon closing of the housing sections, the cleaning pad is held stationary so that accurate alignment and therefore effective cleaning of the console edge connector is achieved by insertion and removal of the cartridge within the console port.

The cleaning pad configuration is such that it may be reversed so that either the front or rear edge is presented within recess 28 for cleaning.

Referring now to FIGS. 6, 9, 9A and 10, an additional support element 122 is molded or otherwise secured to the interior surface of top wall 18. Element 122 includes a centrally oriented, upstanding projection 124 and a pair of lower and laterally extending projections 126, 128. When the upper and lower sections A, B of the housing are closed, the interior surface of recessed area 63 rests on projections 126, 128, while projection 124 is received within a slot 130 formed in the recessed area 63. This arrangement insures precise alignment of the housing sections upon closing.

Rearwardly of abutment wall 98 there is a space within the housing portion large enough to store another cleaning tool 132, for cleaning the cartridge connector (not shown). The tool 132 comprises an elongated, plastic member 134, one end of which is wrapped with a cleaning or washing material 136, and the other end of which is wrapped with a drying material 138. Any suitable lint-free fabrics may be used for the washing and drying material.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A cleaning cartridge for an electronic game console comprising:

a housing portion having a recess formed along one side thereof a substantially planar cleaning pad; and means for locating said planar cleaning pad within said recess; and wherein at least a portion of said pad is covered with a cleaning fabric adapted for engagement with an edge connector in the game console.

2. A cleaning cartridge as defined in claim 1 wherein said housing portion comprises first and second separable sections including releasable locking means for holding the first and second separable sections together.

3. The cleaning cartridge of claim 1 wherein said cleaning fabric comprises a lint-free synthetic material.

4. The cleaning cartridge of claim 1 wherein at least two edge portions of said cleaning pad are covered with said cleaning fabric.

5. The cleaning cartridge of claim 4 wherein said cleaning pad is reversible to permit use of either of said at least two edge portions to clean the edge connector.

6. The cleaning cartridge of claim 1 and including tool means for cleaning an edge connector in a game cartridge, said tool means adapted to be stored within said cleaning cartridge when not is use.

7. A cleaning kit for an electronic game console and associated game cartridges, the game console having a port adapted to receive a game cartridge, the port providing access to a first edge connector in the console adapted to engage a mating second edge connector provided in the game cartridge, the kit including:

a first planar cleaning element sized and shaped to correspond substantially to the second edge connector, so that said cleaning pad engages the first edge connector upon insertion into the port;

a second cleaning element for cleaning the second edge connector in the game cartridge; and a cartridge having a housing portion at one end and a handle portion at the other end, the housing portion having a recess in a forward end thereof, said first cleaning element secured within said cartridge so that a forward edge of said cleaning element is located within said recess.

8. The cleaning kit according to claim 7 wherein said recess and said first cleaning element are configured substantially identically to a forward portion of an associated game cartridge.

* * * * *